United States Patent [19]

Scott

[11] 4,159,935

[45] Jul. 3, 1979

[54] CONVERSION OF HYDROCARBONACEOUS BLACK OILS

[75] Inventor: Norman H. Scott, Arlington Heights, Ill.

[73] Assignee: UOP Inc., Des Plaines, Ill.

[21] Appl. No.: 938,183

[22] Filed: Aug, 30, 1978

[51] Int. Cl.[2] ..... C10G 37/02; C10G 37/06

[52] U.S. Cl. ..... 208/59; 208/58; 208/93; 208/100; 208/101; 208/102; 208/104

[58] Field of Search ..... 208/58, 59, 93, 100, 208/101, 102, 104

[56] References Cited

U.S. PATENT DOCUMENTS

| | | | |
|---|---|---|---|
| 3,364,134 | 1/1968 | Hamblin | 208/93 |
| 3,371,029 | 2/1968 | Weiland | 208/102 |
| 3,371,030 | 2/1968 | Penisten et al. | 208/102 |
| 3,375,189 | 3/1968 | Hamblin | 208/59 |
| 3,402,122 | 9/1968 | Atwater et al. | 208/101 |
| 3,801,494 | 4/1974 | Moore et al. | 208/79 |

*Primary Examiner*—Herbert Levine
*Assistant Examiner*—G. E. Schmitkons
*Attorney, Agent, or Firm*—James R. Hoatson, Jr.; Robert W. Erickson; William H. Page, II

[57] ABSTRACT

Hydrocarbonaceous black oils are converted into lower-boiling hydrocarbons via a process which utilizes two separate catalytic reactor systems interconnected by way of a multiple-stage separation facility. Fresh feed charge stock is reacted in the first reactor system in admixture with hydrogen recovered from the second reactor system. Conversely, unconverted material from the first reactor system is reacted in the second system with make-up hydrogen and all the recycle hydrogen recovered from both reactor systems.

12 Claims, 1 Drawing Figure

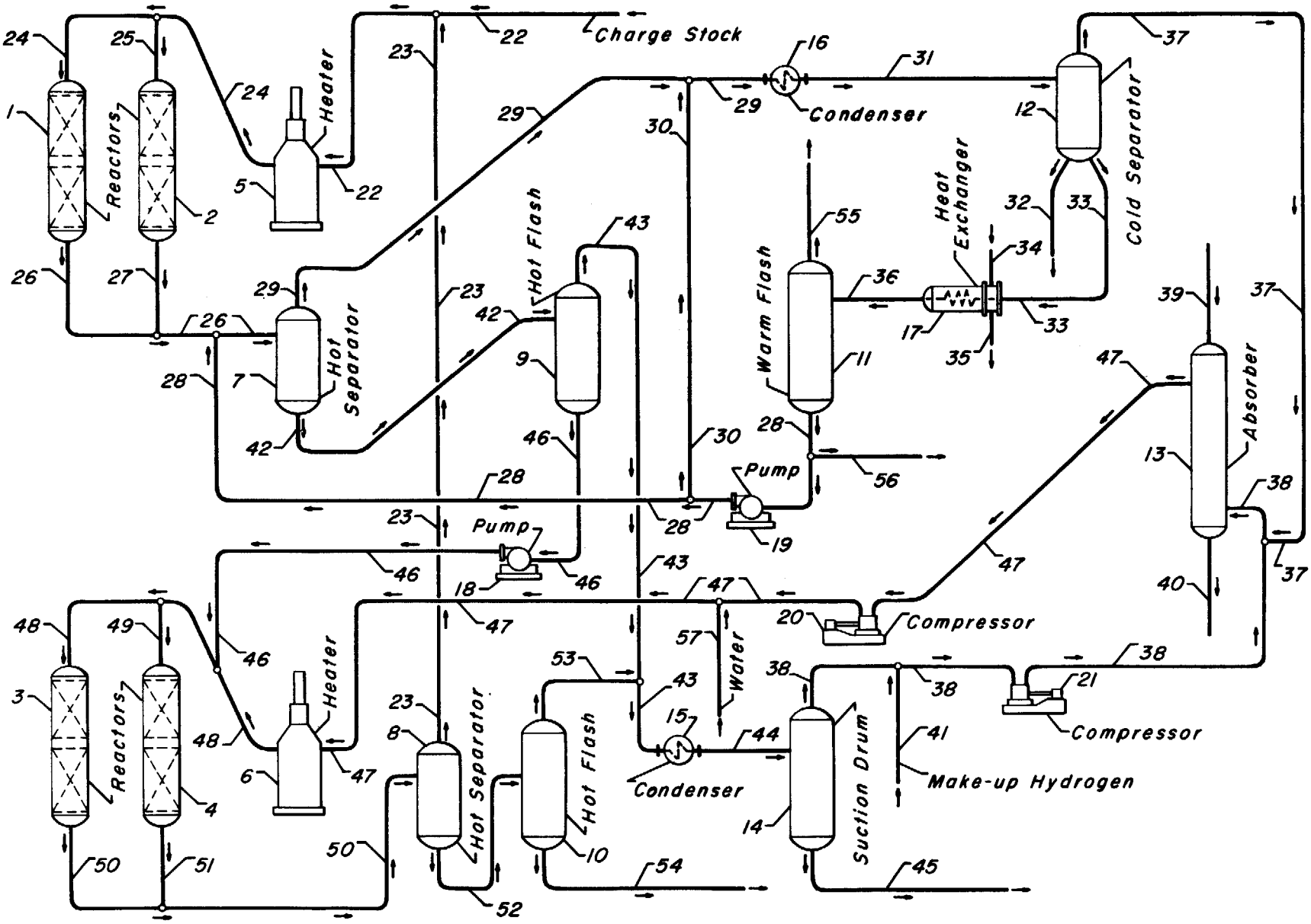
Absorber
Cold Separator
Heat Exchanger
Condenser
Charge Stock
Warm Flash
Pump
Compressor
Make-up Hydrogen
Suction Drum
Water
Hot Flash
Hot Separator
Heater
Reactors

CONVERSION OF HYDROCARBONACEOUS BLACK OILS

APPLICABILITY OF INVENTION

As herein described, the process encompassed by my inventive concept is especially adaptable for the mixed-phase conversion of a heavier-than-gasoline hydrocarbonaceous feedstock. More specifically, the present invention involves the use of two individual catalytic reactor systems which are interconnected by a novel, multiple-stage facility for separating the mixed-phase reaction product effluent. In a broad interpretation, the process, hereinafter described in detail, is applicable to hydrocarbon conversion which may be classified as hydrogen-consuming, and in which the various processing techniques dictate the recycle of a hydrogen-rich gaseous phase. Such hydrogen-consuming processes include the hydrorefining, or hydrotreating of kerosene fractions, middle-distillate fractions, light and heavy vacuum gas oils, light and heavy cycle stocks, etc., for the primary purpose of reducing the concentration of various contaminating influences therein. Another typical hydrogen-consuming process is known in the petroleum refining art as "hydrocracking". Basically, hydrocracking techniques are employed to convert relatively heavy hydrocarbonaceous material into lower-boiling hydrocarbon products including gasoline, kerosene and fuel oil.

Relatively recent developments in the area of petroleum technology have indicated that the hydrocracking reactions can be applied successfully to residual stocks, or the so-called "black oils". Exemplary of such material are atmospheric tower bottoms products, vacuum tower bottoms products (vacuum residuum), crude residuum, topped crude oils, crude oils extracted from tar sands, etc. Black oils are generally characterized by a boiling range indicating that 10.0% or more, by volume, boils above a temperature of about 1050° F. (565.6° C.). Although the amount is not known accurately, a significant quantity of black oils currently exist which are characterized in that more than about 50.0% by volume boils above a temperature of about 1050° F. (565.6° C.). One specific example of a black oil is a vacuum residuum having a gravity of 8.8° API, and containing 3.0% by weight of sulfur and 4300 ppm. of nitrogen, and having a 20.0% volumetric distillation point of 1055° F. (568.3° C.). As hereinafter indicated by specific example and by the embodiment presented for illustrative purposes in the accompanying drawing, the utilization of the present process affords advantages when utilized for the conversion of such black soils. It will be noted, however, that the foregoing brief description of petroleum processes utilize hydrocarbonaceous charge stocks boiling above the gasoline boiling range—i.e. having an initial boiling point above about 400° F. (204.4° C.).

OBJECTS AND EMBODIMENTS

A principal object of the present invention is to provide an economically feasible catalytic process for the desulfurization and conversion of black oils into distillable hydrocarbons of lower molecular weight and boiling range. A corollary objective is to provide an integrated separation technique which effects a decrease in hydrogen loss while effecting the conversion of hydrocarbonaceous black oils.

Another object of the present invention is to provide an improved black oil conversion process utilizing an improved separation technique for separating the mixed-phase reaction product effluent, which product effluent contains hydrogen, normally liquid hydrocarbons and normally gaseous hydrocarbons.

These and other objects are achieved by the present invention as more completely described hereinbelow, especially with reference to the accompanying drawing which is a simplified representation of several embodiments.

In a broad embodiment, the present invention directs itself toward a process for the conversion of a black oil charge stock, of which at least 10.0% by volume boils above about 1050° F. (565.6° C.), which process comprises the sequential steps of: (a) reacting said charge stock and hydrogen, in a first catalytic reactor system, at a temperature above about 700° F. (371.1° C.) and a pressure greater than about 1000 psig. (69.1 atm.); (b) separating the resulting first reaction product effluent, in a first separation zone, under substantially the same pressure and a temperature not substantially exceeding 750° F. (398.9° C.), to provide a first vaporous phase and a first liquid phase; (c) cooling said first vaporous phase to a temperature in the range of 50° F. (10° C.) to about 150° F. (65.6° C.), and separating the cool vaporous phase, in a second separation zone at substantially the same pressure as said first separation zone, to provide (i) a hydrogen-rich second vaporous phase and, (ii) a methane-containing second liquid phase; (d) increasing the temperature of said second liquid phase, and separating the heated liquid phase, in a third separation zone at a substantially reduced pressure, said temperature and pressure being selected to provide (i) a third liquid phase and, (ii) a third vaporous phase containing at least about 70.0% of the methane contained in said second liquid phase; (e) admixing a first portion of said third liquid phase with said first vaporous phase and a second portion with said first reaction product effluent; (f) separating said first liquid phase at substantially the same temperature, in a fourth separation zone under a substantially reduced pressure below about 1000 psig. (69.07 atm.), to provide (i) a fourth liquid phase and, (ii) a fourth vaporous phase; and, (g) further reacting said fourth liquid phase with hydrogen in a second catalytic reactor system at an increased pressure above about 1000 psig. (69.07 atm.).

In another embodiment, at least a portion of the second vaporous phase is heated to a temperature above about 700° F. (371.1° C.), and introduced into said second catalytic reactor system.

In a specific embodiment, the second liquid phase is heated to a temperature in the range of about 250° F. (121.1° C.) to about 500° F. (260° C.), and said third separation zone is maintained under a pressure in the range of about 200 psig. (14.61 atm.) to about 450 psig. (31.63 atm.).

These, as well as other objects and embodiments, will become evident from the following more detailed description of the present black oil conversion process and the separation technique integrated therein. In one such other embodiment, the product effluent from the second catalytic reactor system is separated, in a fifth separation zone, at substantially the same pressure and at a temperature not substantially exceeding 800° F. (426.7° C.), to provide (i) a fifth vaporous phase and, (ii) a fifth liquid phase, at least a portion of said fifth vaporous phase being admixed with said charge stock and introduced therewith into said first catalytic reactor system.

CITATION OF RELEVANT PRIOR ART

It must be recognized and acknowledged that the prior art is replete with techniques for effecting black oil conversion and separation of the mixed-phase reaction product effluent. A perusal of the prior art Classes 208-59, 208-93, 208-101 and 208-102 indicates that such is the case. The five delineated references discussed below are appropriate to the present black oil conversion process; therefore, copies thereof accompany this application.

In U.S. Pat. No. 3,364,134 (Cl. 208-93), issued to R. J. J. Hamblin on Jan. 16, 1968, a black oil conversion process is described which involves four separation zones (one of which initially separates the fresh feed charge stock) and two reaction vessels. The invention is stated as encompassing a method whereby the asphaltic material in the charge stock is maintained in a dispersed state within a liquid phase which is rich in hydrogen. The fresh feed charge stock is initially separated in the first separation zone (atmospheric flash column) to provide a light fraction having an end boiling point of 650° F. (343.3° C.) to about 850° F. (454.4° C.), and a heavy fraction having an initial boiling point above about 650° F. (343.3° C.).

The heavy fraction is admixed with make-up and all the recycled hydrogen, and reacted in a first reaction zone, the effluent from which is introduced into a hot separator functioning at a temperature of about 700° F. (371.1° C.) to about 750° F. (398.9° C.) and at substantially the same pressure. Hot separator liquid is introduced into a hot flash separation zone at a substantially reduced pressure below about 100 psig. (7.81 atm.) and at a temperature of about 550° F. (287.8° C.) to about 900° F. (482.2° C.). Hot flash liquid is withdrawn from the process as residuum while the hot flash vapors are admixed with the hot separator vapors and the atmospheric flash light fraction, and reacted in the second reaction zone. Product effluent from the second reaction zone is introduced into a cold separator at substantially the same pressure and at a temperature of about 60° F. (15.6° C.) to about 130° F. (54.4° C.). A hydrogen-rich vaporous phase is withdrawn from the cold separator and recycled to the first reaction zone; the cold separator liquid phase is recovered as the product of the process. With respect to the foregoing described process, it will be noted that there is no recognition of flash separating the cold separator liquid phase at an elevated temperature in a warm flash separation zone. Certainly, therefore, there exists no disclosure relative to the decrease in hydrogen loss. Additionally, the disclosed use of the two reactor systems is contrary to the present process in that the effluent from the second system is introduced into a cold separator.

A hot separator, cold separator and hot flash zone are utilized in conjunction with a vacuum column in U.S. Pat. No. 3,371,030 (Cl. 208-102), issued to J. R. Penisten et al. on Feb. 27, 1978. Reaction product effluent is introduced into the hot separator, the vaporous phase from which is condensed and introduced into the cold separator; hot separator liquid is introduced into the hot flash zone below a mesh blanket contained therein. The hot flash zone functions at a temperature substantially the same as the hot separator, but at a reduced pressure below about 200 psig. (14.61 atm.). This vessel serves to concentrate the 400° F.-plus (204.4° C.) hydrocarbons in a liquid phase which is in turn introduced into the vacuum column. A portion of the recovered heavy vacuum gas oil is reintroduced into the hot flash zone above the mesh blanket, functioning as a wash oil. Cold separator liquid is admixed with hot flash vapors and recovered as the product of the process.

The process described in U.S. Pat. No. 3,375,189 (Cl. 208-59), issued to R. J. J. Hamblin on Mar. 26, 1978, is similar to that of U.S. Pat. No. 3,364,134 summarized above. Here, the hot separator vapors and the hot flash vapors from a first reaction zone effluent are combined and reacted in a second reaction zone. The effluent from the latter is introduced into a cold separator, the hydrogen-rich vapors from which are recycled to the first reaction zone. Cold separator liquid components are fractionated to provide a 400° F.-plus (204.4° C.) fraction which is reacted in a third reaction zone, from which the product effluent is introduced into a second cold separator. The liquid phase from the latter is fractionated in admixture with the liquid phase from the first cold separator.

U.S. Pat. No. 3,402,122 (Cl. 208-101), issued to B. L. Atwater et al. on Sept. 17, 1968, discloses a separation technique for recovering an absorption medium from a black oil reaction product effluent. Utilized are a hot separator, a cold separator, a hot flash zone and a cold flash zone. Salient features include recovering the absorption medium from condensed hot flash vapors and also introducing cold flash liquid into the cold separator. Again, there exists no recognition of increasing the temperature of the cold separator liquid and introducing it into a warm flash zone.

A somewhat similar separation technique is presented in U.S. Pat. No. 3,371,029 (Cl. 208-102), issued to J. N. Weiland to Feb. 27, 1968. Again, four separation zones are involved: a hot separator, hot flash, cold separator and cold flash. Hot separator vapors are condensed and introduced into the cold separator, while the hot separator liquid phase passes into the hot flash zone. Hot flash zone vapors are condensed, admixed with the cold separator liquid phase and introduced into the cold flash zone at a temperature of about 105° F. (40.6° C.) and a pressure below about 200 psig. (14.61 atm.). A portion of the cold flash liquid phase is recycled to the cold separator; the remainder being admixed with the hot flash liquid phase and subjected to fractionation for desired product recovery.

From the foregoing description of the prior art techniques, it becomes readily apparent that the prior art is not cognizant of the inventive concept described herein. Although some of these illustrative processes utilize multiple-stage product effluent separation integrated into a two reactor system black oil process, none employ the technique of reacting the fresh feed in a first system, in admixture with hydrogen recovered from the second system, and reacting unconverted material from the first system in the second system, with make-up hydrogen and all the recycle hydrogen recovered from both reactor systems. Furthermore, none employ the technique of increasing the temperature of the cold separator liquid phase and introducing the same into a warm flash zone at a pressure above about 200 psig. (14.61 atm.). Therefore, such prior processes cannot offer a reduction in hydrogen solution loss as afforded by the present inventive concept.

SUMMARY OF INVENTION

From the foregoing brief description, it will be readily ascertained, by those possessing the requisite skill in the petroleum refining art, that the present black oil conversion process makes use of a unique two reactor system flow scheme which is interconnected by a series of integrated steps for the separation of the mixed-phase reaction product effluent. Although primarily intended for black oil conversion, it will be recognized that the present process and separation technique are equally applicable to heavier-than-gasoline feedstocks which are not considered to fall within the black oil designation. In further describing the present invention and the process encompassed thereby, an illustrative conversion of a hydrocarbonaceous black oil will be utilized. Black oil conversion is intended to accomplished two primary objects: first, to effect desulfurization of the feedstock to the extent dictated by the desired end product, whether maximizing fuel oil, kerosene or gasoline boiling range hydrocarbons; secondly, it is intended to maximize the yield of "distillable hydrocarbons", being those normally liquid hydrocarbons having normal boiling points below 1050° F. (565.6° C.).

Conversion conditions are those which are imposed upon one or more reaction vessels for the purpose of achieving both desulfurization and the production of lower-boiling hydrocarbon products. Precise conditions for a given unit depend primarily upon (1) the physical and chemical characteristics of the charge stock, and, (2) the character of the intended product slate. The process and separation technique does not depend for viability upon the operating conditions utilized in the catalytic reaction zones; those which are employed in the prior art processes hereinabove delineated continue to be suitable. For the most part, it will be noted that these conversion conditions are significantly less severe than those being currently commercially used; distinct economic advantages will be recognized. Briefly, the conversion conditions include temperatures above about 700° F. (371.1° C.), with an upper limit of about 800° F. (426.7° C.), as measured at the inlet to the fixed-bed of catalyst particles disposed within the reaction zone. Since the bulk of the reactions being effected are exothermic in nature, the effluent from the reaction zone will exhibit a higher temperature. In order that catalyst stability be preserved, it is preferred to control the exothermicity of reaction to the extent that the product effluent temperature does not exceed about 900° F. (482.2° C.). Hydrogen is admixed with the black oil charge stock, by way of compressive means, in an amount generally not exceeding about 10,000 standard cubic feet of gas per barrel of said charge stock, at the selected operating pressure; hydrogen is present in the recycled vaporous phase in an amount of about 80.0% by volume, or more. Preferably, the quantity of hydrogen will be in the range of about 3,000 to about 6,000 standard cubic feet per barrel. Black oil conversion requires superatmospheric pressures generally exceeding about 1,000 psig. (69.07 atm.), and usually in the range of about 1500 psig. (103.1 atm.) to about 3000 psig. (205.2 atm.). The black oil is introduced into the reaction vessel at a liquid hourly space velocity (defined as volumes of liquid hydrocarbon charge per hour per volume of catalyst disposed within the reaction zone) of from about 0.25 to about 2.0.

As hereinbefore stated, the present black oil conversion process employs two separated catalytic reactor systems. Preferably for large units, as illustrated in the accompanying drawings, each system comprises a pair of parallel reactors; particularly preferred is the configuration wherein each of the parallel reactors contains at least two individual catalytic reaction zones. Black oil units are seldom designed for a charge rate less than 50,000 Bbl/day, and the indicated preference for reactor systems facilitates control of the exothermicity of reaction such that catalyst activity and stability are preserved. Furthermore, the utilization of two reaction zones in each of the parallel reactors permits the introduction of a liquid or vaporous quench stream therebetween. Fresh charge stock, in admixture with a hydrogen-rich vaporous phase, is introduced into the first catalytic reactor system, with approximately 50.0% of the total going to each of the two parallel reactors. The hydrogen-rich stream is the vaporous phase recovered from a hot separator into which the product effluent from the second catalytic reactor system is introduced.

Since the physical and/or chemical characteristics of the catalytic composite forms no essential feature of my invention, there exists no necessity for a lengthy description herein. Suffice to state that a plethora of suitable hydrocracking/desulfurization catalysts are disclosed in the literature, some of which are discussed in the prior art hereinbefore delineated. Briefly, however, such catalysts are composites of one or more metallic components from the metals of Groups VI and VIII, combined with a refractory inorganic oxide, either zeolitic, or amorphous—e.g. a combination of alumina and silica. For this type of service, the catalytic composites are generally reduced and sulfided prior to use.

Reaction product effluent is introduced into a first hot separator at substantially the same pressure and at a temperature not substantially exceeding 750° F. (398.9° C.). Since this reaction product effluent was derived from the fresh black oil charge stock, the first hot separator functions above 700° F. (371.1° C.) to prevent ammonium compounds from being withdrawn with the liquid phase, and below 750° F. (398.9° C.) to keep heavier material out of the vaporous phase. In most black oil conversion units, the effluent from the reaction zone will be at a level exceeding 750° F. (398.9° C.), and hence must be cooled; this may be accomplished by using a portion of the warm flash zone liquid phase, as shown in the accompanying drawing and as hereinafter described. The vaporous phase from the hot separator is admixed with a second portion of warm flash zone liquid, condensed and introduced into a cold separator at substantially the same pressure and a temperature of from 50° F. (10° C.) to about 150° F. (65.6° C.). The liquid phase from the hot separator passes into a hot flash zone at substantially the same temperature, but at a substantially reduced pressure of from about 100 psig. (7.81 atm.) to about 400 psig. (28.23 atm.).

In the present specification and the appended claims, the term "substantially the same pressure" is intended to connote that no intentional actions are taken either to decrease, or increase the stream pressure between one vessel and another; obviously, there will be a drop in pressure due to fluid flow through the system. Similarly, the phrase "substantially the same temperature" indicates that a given stream is neither intentionally heated, nor cooled when passing from one vessel to another. Thus, hot flash zone liquid components will be raised in pressure prior to being introduced into the second catalytic system, whereas the pressure of the vaporous phase will decrease somewhat only as a result of flow through the system.

Cold separator liquid phase components are introduced into a heat-exchanger, in which they are indirectly contacted with a hotter process stream, to raise the temperature to a level in the range of about 250° F. (121.1° C.) to about 500° F. (260° C.). The thus-heated liquid phase passes into the warm flash zone at a substantially reduced pressure of from 200 psig. (14.61 atm.) to about 450 psig. (31.63 atm.). Warm flash zone vapors are sent to suitable fractionation facilities for the recovery of various product streams. As above stated, a portion of the warm flash zone liquid phase is combined with the first catalytic reactor system effluent to quench the same to a temperature below about 750° F. (398.9° C.), and a second portion serves as a hydrogen enrichment fluid by being combined with the first hot separator vaporous phase prior to condensation and introduction into the cold separator. To illustrate the use of this warm flash zone with the cold flash zone of the prior art, a basis of 50,000 Bbl/day fresh feed will be used. Using the cold flash zone at a pressure of about 50 psig. (4.40 atm.) and a temperature of about 125° F. (51.7° C.), the hydrogen solution loss is about 114.8 scf/Bbl. Utilization of the warm flash zone, in accordance with the present process, at a pressure of 300 psig. (21.42 atm.) and a temperature of about 363° F. (183.9° C.), the solution loss drops markedly to 102.5 scf/Bbl., or 12.0%. the difference of 12.3 scf/Bbl., assuming an average current hydrogen cost of $2.50/1000 scf., is about $1,535.00/day. Since most petroleum refinery processing units function for about 330 days per year, the annual savings in hydrogen costs exceeds $500,000.00.

The liquid phase from the first hot flash zone, containing primarily the heavier components and unreacted 1050° F.-plus (565.6° C.) material in the effluent from the first catalytic reactor system effluent, serves as the charge stock to the second catalytic reactor system. The pressure thereof is increased and a heated hydrogen-rich recycle stream is admixed therewith. Since the hot flash zone liquid is obtained at a temperature approximating 745° F. (396.1° C.), there is no need to introduce it into the direct-fired heater which raises the temperature of the recycled hydrogen, the source of which is hereafter set forth. The reaction product effluent from the second catalytic system is introduced into a second hot separator. In most situations, the effluent will not require quenching; the pressure imposed upon the second reactor system will generally be about 150 psig. (11.21 atm.) to about 200 psig. (14.61 atm.) higher than that imposed upon the first reactor system. Therefore, the second system product effluent will be introduced into the second hot separator at temperatures up to about 850° F. (454.4° C.); hot separator pressure is substantially the same as the second system outlet pressure.

The vaporous phase from the second hot separator, concentrated in hydrogen, is admixed with the fresh black oil charge stock prior to passing the same into the direct-fired heater and into the first catalytic reactor system. Hot separator liquid phase components are introduced into a second hot flash zone at substantially the same temperature and a pressure in the range of about 100 psig. (7.81 atm.) to about 400 psig. (22.23 atm.), the same range under which the first hot flash zone functions. Hot flash liquid phase components, containing the unreacted 1050° F.-plus (565.6° C.) material, is sent to a fractionation facility for product stream recovery. Vaporous phase components from the second hot flash zone are combined with the vaporous phase from the first hot flash zone, the mixture being condensed at a temperature in the range of about 50° F. (10° C.) to about 150° F. (65.6° C.) and introduced into a compressor suction drum, or knock-out pot.

Normally liquid material is withdrawn as a bottoms stream for separation in a fractionation facility for product stream recovery. The hydrogen-rich gaseous phase is admixed with the required quantity of make-up hydrogen, compensating for that consumed chemically in the overall process, the mixture being introduced into a compressor which increases the pressure to the extent required to permit the same to be combined with the hydrogen-rich vaporous phase recovered from the aforementioned high-pressure cold separator. Hydrogen sulfide is removed from the combined stream, for example in an absorber utilizing diethanolamine as the absorbent. The hydrogen sulfide-depleted hydrogen recycle is again increased in pressure, passed into a second direct-fired heater and admixed with the liquid phase from the first hot flash zone.

BRIEF DESCRIPTION OF DRAWING

In further describing the present invention and the hydrocarbon conversion process encompassed thereby, reference will be made to the accompanying drawing which is illustrative of the several embodiments thereof. The drawing is presented by way of a relatively simplified schematic flow diagram in which only the principal vessels are shown. Reduced in number, or completely eliminated are details such as pumps and compressors, heaters, coolers and condensers, heat-exchangers, start-up lines and heat recovery circuits, fractionation columns, valving, instrumentation and other controls; they are not believed required for a clear understanding of the techniques involved. Utilization of such miscellaneous appurtenances, to modify the illustrated process, is well within the purview of one possessing a reasonable degree of skill in the petroleum refining art, and will not remove the resulting process from the scope and spirit of the appended claims.

Illustrated in the drawing is a particularly preferred reaction zone configuration in which the fresh feed charge stock in line 22 and the vaporous phase from hot separator 8 are processed in a first parallel reactor system 1 and 2, each of which contains two reaction zones. The second parallel reactor system 3 and 4, each of which also contains two reaction zones, is utilized to further react and convert the liquid phase from hot flash zone 9 in admixture with the total hydrogen recycle stream in line 47. In order to simplify the drawing, only two direct-fired heaters 5 and 6 are shown, each of which serves one of the parallel reactor systems. As a practical matter, each parallel reactor system would include two such heaters each of which would raise the temperature of the feed to one of the reactors in each parallel system. It will become evident, from the following detailed description, that this simplification has no effect upon the illustration.

DETAILED DESCRIPTION OF DRAWING

With specific reference now to the drawing, the technique encompassed by my inventive concept will be described in conjunction with a commercially-scaled unit designed for a daily feedstock capacity of 50,000 barrels (331.3 $M^3$/hour). The charge stock is a black oil of the type hereinbefore described, having an average molecular weight of 430, an API gravity of 16.3° and a specific gravity of 7.97 lbs/gal. (951.4 Kg/M$^3$). For the remainder of the description of the drawing, including the several tables which follow, the quantities of the various process streams will be expressed as pound moles/hour. Charge stock, in the amount of about 1,624.3 moles/hour, is introduced into the process by way of line 22 at a temperature of about 350° F. (176.7° C.) and a pressure of about 2,500 psig. (171.2 atm.); the pressure decreases to about 2,400 psig. (167.8 atm.) due to normal fluid flow through a hot oil belt (not illustrated) to increase its temperature from that existing at the storage facility. The charge stock is admixed with about 48,273.86 pound moles/hour of a hydrogen-rich vaporous phase (80.3%) in conduit 23 (derived from hot separator 8), having a temperature of about 800° F. (426.7° C.) and a pressure of about 2,400 psig. (164.4 atm.). The resulting mixture, at a temperature of about 596° F. (313.3° C.) and substantially the same pressure, continues through line 22 into a direct-fired heater 5.

The heated combined feed is withdrawn from heater 5, via line 24, at a temperature of about 755° F. (401.7° C.) and a pressure approximating 2,340 psig. (160.3 atm.). About one-half of the combined feed is diverted through line 25 into reaction chamber 2, the remainder continuing through line 24 into reaction chamber 1. In this illustration, as aforesaid, each chamber contains two individual reaction zones; from a practical viewpoint, this is advantageous in that it permits the use of quench streams intermediate the catalyst beds in order to temper the temperature increase brought about by the exothermic nature of the reactions. Since the quenching technique forms no essential part of the present invention, and is thoroughly described in the prior art, the same is not illustrated in the drawing. Product effluent from chamber 1 is recovered via line 26 and admixed with the product effluent from reaction chamber 2 in conduit 27; the mixture is at a temperature of about 800° F. (426.7° C.) and a pressure of about 2,240 psig. (153.5 atm.). Component analyses of the total combined feed to reactors 1 and 2, and of the total product effluent in line 26, are given in the following Table I.

The total reaction product effluent is initially separated in hot separator 7 at substantially the same pressure and, as previously set forth, at a temperature preferably not exceeding 750° F. (398.9° C.). Therefore, prior to passing the line 26 effluent into hot separator 7, a quench stream obtained via conduit 28 as a liquid phase from warm flash zone 11, is admixed therewith in the amount of about 958.12 moles/hour.

TABLE I:

| Reactors 1 and 2 Component Analyses | | |
|---|---|---|
| Component | Total Charge | Total Effluent |
| Water | 2084.86 | 2111.99 |
| Hydrogen Sulfide | 196.10 | 878.52 |
| Hydrogen | 38764.94 | 35196.52 |
| Methane | 5972.51 | 6033.48 |
| Ethane | 450.77 | 485.59 |
| Propane | 188.12 | 216.65 |
| Butanes | 89.99 | 112.81 |
| Pentanes | 32.41 | 45.96 |
| Hexanes | 20.84 | 34.62 |
| Heptane–400° F. | 99.38 | 195.17 |
| 400° F.–650° F. | 266.13 | 456.72 |
| 650° F.–1050° F. | 107.85 | 1269.93 |
| 1050° F.-plus | — | 159.16 |

TABLE I:-continued

| Reactors 1 and 2 Component Analyses | | |
|---|---|---|
| Component | Total Charge | Total Effluent |
| Fresh Feed | 1624.30 | — |

The quench is at a temperature of 180° F. (82.2° C.) and a pressure of 2,240 psig. (153.5 atm.), which results in a mixture having a temperature of 750° F. (398.9° C.). Hot separator 7 serves primarily to concentrate the hydrogen in a vaporous phase in line 29 while producing a liquid phase, rich in 400° F.-plus (204.4° C.) hydrocarbons, in line 42. Additionally, the purpose of the hot separator is to concentrate all the remaining 1050° F.-plus (565.6° C.) hydrocarbons in the liquid phase. Component analyses of the total feed to hot separator 7, the vaporous phase in line 29 and the liquid phase in line 42 are given in the following Table II.

Vaporous phase components from hot separator 7 are admixed with a second portion of the warm flash zone liquid, in the amount of 2541.88 moles/hour, being diverted through line 30 at a temperature of about 180° F. (82.2° C.) and a pressure of about 2240 psig. (153.5 atm.).

TABLE II:

| Hot Separator (7) Stream Analyses | | | |
|---|---|---|---|
| Component | Total Charge | Line 29 | Line 42 |
| Water | 2111.99 | 2111.99 | — |
| Hydrogen Sulfide | 899.11 | 865.75 | 33.36 |
| Hydrogen | 35208.89 | 34234.38 | 974.51 |
| Methane | 6049.90 | 5862.46 | 187.44 |
| Ethane | 493.83 | 463.67 | 30.16 |
| Propane | 228.36 | 213.64 | 14.73 |
| Butanes | 128.16 | 118.38 | 9.78 |
| Pentanes | 61.24 | 55.51 | 5.73 |
| Hexanes | 55.36 | 49.19 | 6.17 |
| Heptane–400° F. | 603.24 | 501.33 | 101.91 |
| 400° F.–650° F. | 819.65 | 363.69 | 455.96 |
| 650° F.–1050° F. | 1336.31 | 66.37 | 1269.94 |
| 1050° F.-plus | 159.16 | — | 159.16 |

The resulting mixture, having a temperature of about 540° F. (282.2° C.), continues through line 29 into condenser 16. Cooled and condensed components, at a temperature of about 130° F. (54.4° C.) and a pressure of about 2200 psig. (150.8 atm.), are introduced by way of conduit 31 into cold separator 12. Principal functions of cold separator 12 include concentrating hydrogen in the vaporous phase withdrawn via conduit 37, effect substantially complete (98.1%) water removal through line 32 and concentrate the heavier hydrocarbons in the liquid phase recovered in conduit 33. Cold separator stream analyses are presented in Table III.

TABLE III.

| Cold Separator Stream Analyses | | | |
|---|---|---|---|
| Component | Line 31 | Line 37 | Line 33 |
| Water | 2111.99 | 41.18 | — |
| Hydrogen Sulfide | 920.38 | 704.29 | 216.08 |
| Hydrogen | 34267.20 | 33819.93 | 447.27 |
| Methane | 5906.04 | 5585.03 | 321.00 |
| Ethane | 485.52 | 405.30 | 80.22 |
| Propane | 244.72 | 161.84 | 82.87 |
| Butanes | 159.10 | 71.58 | 87.52 |
| Pentanes | 96.05 | 21.90 | 74.15 |
| Hexanes | 104.23 | 12.09 | 92.14 |
| Heptane–400° F. | 1583.96 | 17.79 | 1566.17 |
| 400° F.–650° F. | 1326.57 | 0.02 | 1326.55 |
| 650° F.–1050° F. | 242.49 | — | 242.49 |

TABLE III.-continued

| Component | Cold Separator Stream Analyses Line 31 | Line 37 | Line 33 |
|---|---|---|---|
| 1050° F.-plus | — | — | — |

Cold separator liquid components, at a temperature of about 130° F. (54.4° C.), are introduced into heat-exchanger 15 wherein they are contacted by a suitable heat-exchange medium entering via line 34 and exiting via line 35. The temperature is increased to about 363° F. (183.9° C.), and the liquid components are introduced via line 36 into warm flash zone 11 at a pressure of about 300 psig. (21.42 atm.). As previously stated in the discussion of the appropriate prior art, warm flash zone 11 is the contradistinction over prior art techniques in which cold separator liquid components pass into a cold flash zone. Warm flash zone 11 serves to remove at least about 70.0% of the incoming methane in the vapor phase withdrawn via line 55; in the present illustration, methane removal is about 81.3%. Therefore, there exists no necessity to withdraw a drag stream via line 56 in order to prevent the build-up of methane in the above-described separation cycle. About 3499.79 moles/hour of warm flash zone liquid in line 28 are introduced into pump 19, by which the pressure is increased to about 2300 psig. (157.6 atm.). Of this amount, approximately 2541.88 moles/hour are diverted through line 30 to be admixed with the vaporous phase in line 29 from hot separator 7. The remainder continues through line 30 to serve as quench for the reaction product effluent in line 26. Warm flash zone 11 stream analyses are given in the following Table IV:

TABLE IV:

| Component | Warm Flash Zone Stream Analyses Line 55 | Line 28 |
|---|---|---|
| Water | — | — |
| Hydrogen Sulfide | 140.87 | 75.21 |
| Hydrogen | 402.07 | 45.20 |
| Methane | 261.00 | 60.01 |
| Ethane | 50.13 | 30.09 |
| Propane | 40.09 | 42.79 |
| Butanes | 31.45 | 56.07 |
| Pentanes | 18.32 | 55.82 |
| Hexanes | 6.36 | 75.78 |
| Heptane-400° F. | 75.50 | 1490.67 |
| 400° F.-650° F. | 0.88 | 1325.68 |
| 650° F.-1050° F. | — | 242.48 |

Liquid phase components in line 42, from hot separator 7, at about 750° F. (398.9° C.) and a pressure of about 2240 psig. (153.5 atm.), are introduced into hot flash zone 9 at about 745° F. (396.1° C.) and the significantly lower pressure of about 245 psig. (17.68 atm.). The principal function of hot flash zone 9 is to recover a vaporous phase, in line 43 having substantially no hydrocarbons boiling above about 1050° F. (565.6° C.). This heavier material, representing unconverted raw oil, and the greater proportion of all the 400° F.-1050° F. (202.4° C.-565.6° C.) normally liquid components are recovered by way of line 46. This liquid phase, after being increased in pressure, via pump 18, to about 2500 psig. (171.2 atm.) continues through line 46 as the feed to the second parallel reactor system illustrated as zones 3 and 4. Stream analyses of the liquid and vaporous phases from hot flash zone 9 are given in Table V.

TABLE V.

| Component | Hot Flash (9) Stream Analyses Line 43 | Line 46 |
|---|---|---|
| Water | — | — |
| Hydrogen Sulfide | 30.19 | 3.18 |
| Hydrogen | 907.14 | 67.37 |
| Methane | 174.03 | 13.41 |
| Ethane | 25.40 | 4.76 |
| Propane | 12.07 | 2.65 |
| Butanes | 7.63 | 2.16 |
| Pentanes | 4.17 | 1.56 |
| Hexanes | 4.20 | 1.96 |
| Heptane-400° F. | 57.20 | 44.71 |
| 400° F.-650° F. | 81.75 | 374.21 |
| 650° F.-1050° F. | 32.34 | 1237.60 |
| 1050° F.-plus | — | 159.16 |

Vaporous components from hot flash zone 9, in line 43, are admixed with about 1154.09 moles/hour of a vaporous phase, from a second hot flash zone 10, in line 53; the latter is at a temperature of about 794° F. (423.3° C.). The mixture, at a temperature of about 768° F. (408.9° C.) and a pressure of about 245 psig. (17.34 atm.), continues through line 43 into condenser 15 wherein the temperature is decreased to a level of about 120° F. (48.9° C.). Condensed material is introduced, via conduit 44, into a compressor suction drum 14 at a pressure of about 225 psig. (16.32 atm.). A hydrogen-rich (80.3%) vaporous phase is recovered through line 38, while the condensed material is recovered by way of conduit 45 and transmitted thereby to suitable product recovery facilities. Stream analyses of the suction drum vapor and liquid phases, and the total feed thereto, are presented in Table VI.

TABLE VI.

| Component | Suction Drum Stream Analyses Line 44 | Line 38 | Line 45 |
|---|---|---|---|
| Water | — | — | — |
| Hydrogen Sulfide | 35.55 | 33.14 | 2.41 |
| Hydrogen | 1752.24 | 1748.63 | 3.61 |
| Methane | 323.06 | 318.91 | 4.15 |
| Ethane | 45.94 | 43.67 | 2.27 |
| Propane | 20.55 | 17.80 | 2.75 |
| Butanes | 12.17 | 8.60 | 3.57 |
| Pentanes | 6.07 | 2.67 | 3.38 |
| Hexanes | 5.58 | 1.37 | 4.21 |
| Heptane-400° F. | 66.11 | 1.60 | 64.51 |
| 400° F.-650° F. | 134.68 | — | 134.68 |
| 650° F.-1050° F. | 88.26 | — | 88.26 |
| 1050° F.-plus | 0.01 | — | 0.01 |

Since the reactions being effected are principally exothermic in nature, hydrogen is consumed in the overall process. Therefore, make-up hydrogen is introduced into the process via conduit 41, in the amount of 5939.23 moles/hour (97.0% purity), and admixed with the suction drum vapors in line 38. Compressor 21 increases the pressure from a level of about 200 psig. (14.61 atm.) to about 2200 psig. (150.8 atm.); the compressed vapors are admixed with the vaporous phase from cold separator 12 in line 37, the mixture continuing through line 38 into the lower end of an amine absorber 13. Lean amine absorbent solution is introduced into the upper end through line 39. Absorber 13 serves to remove hydrogen sulfide from the combined hydrogen-rich vapors; the rich amine solution, containing 663.69 moles/hour of hydrogen sulfide, 102.74 moles/hour of hydrogen and 3.18 moles/hour of methane, is recovered via conduit 40 and transmitted thereby to a suitable amine absorbent regeneration facility. Component analyses of the total feed to amine absorber 13 and the hydrogen-rich recycle gas in line 47, of reduced hydrogen sulfide content, are given in Table VII.

The hydrogen sulfide depleted vapors are recovered from absorber 13, at a temperature of about 160° F. (71.1° C.) and a pressure approximating 2195 psig. (150.42 atm.), and continue through line 47 into recycle gas compressor 20, wherein the pressure is increased to about 2610 psig. (178.7 atm.), the temperature increasing to about 190° F. (26.1° C.). Water, in the amount of about 2024.29 moles/hour, is introduced by way of line 57 at a temperature of 100° F. (37.8° C.).

TABLE VII:

| Amine Absorber Stream Analyses | | |
|---|---|---|
| Component | Total Feed | Line 47 |
| Water | 41.18 | 41.18 |
| Hydrogen Sulfide | 737.43 | 73.74 |
| Hydrogen | 41329.60 | 41226.85 |
| Methane | 6082.11 | 6078.93 |
| Ethane | 448.98 | 448.98 |
| Propane | 179.64 | 179.64 |
| Butanes | 80.18 | 80.18 |
| Pentanes | 24.58 | 24.58 |
| Hexanes | 13.46 | 13.46 |
| Heptane-400° F. | 19.39 | 19.39 |
| 400° F.-650° F. | 0.02 | 0.02 |
| 650° F.-1050° F. | — | — |

The mixture continues through conduit 47 at a pressure of about 2610 psig. (178.7 atm.) and a temperature of about 178° F. (81.1° C.), and is introduced thereby into direct-fired heater 6. The thus-heated material, at a pressure of about 2500 psig. (171.2 atm.) and a temperature of about 854° F. (456.7° C.), is withdrawn via line 48 and admixed with the liquid phase, from hot flash zone 9, in line 46. Approximately one-half of the resulting mixture, which is at a temperature of about 784° F. (417.8° C.), is diverted through conduit 41 into reaction zone 4, the remainder continuing through line 48 into reaction zone 3. Reaction product effluent, at about 800° F. (426.7° C.) and a pressure of about 2400 psig. (164.4 atm.), is recovered from reactor system 3 via line 50 and from reactor system 4 via line 51; these are combined and introduced into hot separator 8 via conduit 50. Component analyses of the total feed to reactor systems 3 and 4, and the total reaction product effluent therefrom are presented in Table VIII:

TABLE VIII:

| Reactors 3 and 4 Component Analyses | | |
|---|---|---|
| Component | Total Charge | Total Effluent |
| Water | 2065.47 | 2084.86 |
| Hydrogen Sulfide | 76.92 | 201.92 |
| Hydrogen | 41294.22 | 39665.92 |
| Methane | 6092.34 | 6131.52 |
| Ethane | 453.73 | 474.64 |
| Propane | 182.29 | 198.14 |
| Butanes | 82.34 | 95.56 |
| Pentanes | 26.13 | 34.86 |
| Hexanes | 15.42 | 22.72 |
| Heptane-400° F. | 64.10 | 113.44 |
| 400° F.-650° F. | 374.23 | 465.38 |
| 650° F.-1050° F. | 1237.60 | 1172.92 |
| 1050° F.-plus | 159.16 | 150.26 |

Reaction product effluent is introduced into hot separator 8 at a temperature of about 800° F. (426.7° C.) and a pressure of about 2400 psig. (164.4 atm.). A hydrogen-rich vaporous phase is recovered in line 23, in the amount of about b 48,273.86 moles/hour, and admixed with the raw oil charge in line 22. The principally liquid phase is recovered via line 52, and introduced thereby into the second hot flash zone 10 at the reduced pressure of 245 psig. (17.34 atm.) and a temperature of about 794° F. (423.3° C.). Hot separator 8 stream analyses are presented in Table IX.

TABLE IX:

| Hot Separator (8) Stream Analyses | | |
|---|---|---|
| Component | Line 23 | Line 52 |
| Water | 2084.86 | — |
| Hydrogen Sulfide | 196.10 | 5.83 |
| Hydrogen | 38764.94 | 900.95 |
| Methane | 5972.51 | 159.01 |
| Ethane | 450.77 | 23.87 |
| Propane | 188.12 | 10.02 |
| Butanes | 89.99 | 5.58 |
| Pentanes | 32.41 | 2.44 |
| Hexanes | 20.84 | 1.88 |
| Heptane-400° F. | 99.38 | 14.06 |
| 400° F.-650° F. | 266.13 | 199.26 |
| 650° F.-1050° F. | 107.85 | 1065.07 |
| 1050° F.-plus | — | 150.25 |

Hot flash zone 10 liquid components are recovered via conduit 54 and transmitted thereby to suitable product recovery facilities. Vaporous components withdrawn via conduit 53 are combined with the vaporous phase, from the first hot flash zone 9, in conduit 43, and introduced thereby into condenser 15. Hot flash zone stream analyses are given in Table X.

For the purpose of indicating the overall component yields of the black oil conversion process above described, only the following streams are considered: the rich amine solution in line 40; the suction drum liquid phase in line 45; the liquid phase, in line 54, from the second hot flash zone 10; and, the overhead vaporous phase, in line 55, from warm flash zone 11. Hydrogen consumption is about 5198.76 moles/hour; in the following Table XI, neither water, nor hydrogen is indicated.

TABLE X:

| Hot Flash Zone (10) Stream Analyses | | |
|---|---|---|
| Component | Line 54 | Line 53 |
| Water | — | — |
| Hydrogen Sulfide | 0.46 | 5.37 |
| Hydrogen | 55.86 | 845.10 |
| Methane | 9.99 | 149.02 |
| Ethane | 3.33 | 20.54 |
| Propane | 1.54 | 8.48 |
| Butanes | 1.03 | 4.54 |
| Pentanes | 0.55 | 1.89 |
| Hexanes | 0.50 | 1.38 |
| Heptane-400° F. | 5.15 | 8.91 |
| 400° F.-650° F. | 146.33 | 52.93 |
| 650° F.-1050° F. | 1009.14 | 55.92 |
| 1050° F.-plus | 150.24 | 0.01 |

TABLE XI:

| Overall Process Yields | |
|---|---|
| Component | Moles/Hour |
| Hydrogen Sulfide | 807.43 |
| Methane | 278.32 |
| Ethane | 55.73 |
| Propane | 44.38 |
| Butanes | 36.05 |
| Pentanes | 22.23 |
| Hexanes | 21.07 |
| Heptane-400° F. | 145.16 |
| 400° F.-650° F. | 281.89 |
| 650° F.-1050° F. | 1097.40 |

TABLE XI:-continued

| Overall Process Yields | |
|---|---|
| Component | Moles/Hour |
| 1050° F.-plus | 150.25 |

The foregoing specification, particularly when read in conjunction with the illustrative example and the accompanying drawing, clearly illustrates the method of effecting the process of the present invention and the benefits afforded through the utilization thereof.

I claim as my invention:

1. A process for the conversion of a black oil charge stock, of which at least 10.0% by volume boils above about 1050° F., which process comprises the sequential steps of:

(a) reacting said charge stock and hydrogen, in a first catalytic reactor system, at a temperature above about 700° F. and a pressure greater than about 1000 psig.;

(b) separating the resulting first reaction product effluent, in a first separation zone, under substantially the same pressure and a temperature not substantially exceeding 750° F., to provide a first vaporous phase and a first liquid phase;

(c) cooling said first vaporous phase to a temperature in the range of about 50° F. to about 150° F., and separating the cooled vaporous phase, in a second separation zone at substantially the same pressure as said first separation zone, to provide (i) a hydrogen-rich second vaporous phase and, (ii) a methane-containing second liquid phase;

(d) increasing the temperature of said second liquid phase, and separating the heated liquid phase, in a third separation zone at a substantially reduced pressure, said temperature and pressure being selected to provide (i) a third liquid phase and, (ii) a third vaporous phase containing at least about 70.0% of the methane contained in said second liquid phase;

(e) admixing a first portion of said third liquid phase with said first vaporous phase and a second portion with said first reaction product effluent;

(f) separating said first liquid phase at substantially the same temperature, in a fourth separation zone under a substantially reduced pressure below about 1000 psig., to provide (i) a fourth liquid phase and, (ii) a fourth vaporous phase; and, (g) further reacting said fourth liquid phase with hydrogen, in a second catalytic reactor system at an increased pressure above about 1000 psig.

2. The process of claim 1 further characterized in that said fourth liquid phase is reacted in said second catalytic reactor system at substantially the same temperature as it emanates from said fourth separation zone.

3. The process of claim 1 further characterized in that at least a portion of said second vaporous phase is heated to a temperature above about 700° F., and introduced into said second catalytic reactor system.

4. The process of claim 1 further characterized in that the first portion of said third liquid phase is admixed with said first vaporous phase prior to the cooling thereof.

5. The process of claim 1 further characterized in that said second liquid phase is heated to a temperature in the range of about 250° F. to about 500° F., and said third separation zone is maintained under a pressure in the range of about 200 psig. to about 450 psig.

6. The process of claim 1 further characterized in that the reduced pressure in said fourth separation zone is in the range of about 100 psig. to about 400 psig.

7. The process of claim 1 further characterized in that the product effluent from said second catalytic reactor system is separated, in a fifth separation zone, at substantially the same pressure and a temperature not substantially exceeding 800° F., to provide (i) a fifth vaporous phase and, (ii) a fifth liquid phase.

8. The process of claim 7 further characterized in that at least a portion of said fifth vaporous phase is admixed with said charge stock and introduced therewith into said first catalytic reactor system.

9. The process of claim 7 further characterized in that said fifth liquid phase is separated at substantially the same temperature, in a sixth separation zone at a pressure in the range of about 100 psig. to about 400 psig.

10. The process of claim 9 further characterized in that said sixth vaporous phase is admixed with said fourth vaporous phase, the resulting mixture is cooled to a temperature in the range of about 50° F. to about 150° F. and introduced into a seventh separation zone at substantially the same pressure to provide (i) a seventh liquid phase and a hydrogen-rich seventh vaporous phase.

11. The process of claim 10 further characterized in that at least a portion of said seventh vaporous phase is heated to a temperature above about 700° F. and introduced into said second catalytic reactor system.

12. The process of claim 10 further characterized in that (i) said seventh vaporous phase is admixed with said second vaporous phase, (ii) hydrogen sulfide is removed from the resulting mixture and, (iii) the mixture is heated to a temperature above about 700° F. and introduced into said second catalytic reactor system.

* * * * *